US008282492B2

(12) United States Patent
Greenberg et al.

(10) Patent No.: US 8,282,492 B2
(45) Date of Patent: Oct. 9, 2012

(54) GAMING MACHINE VENTILATION SYSTEM

(75) Inventors: Jacob C. Greenberg, Elgin, IL (US); Eleobardo Moreno, St. John, IN (US); Yolanda D. Whisenton, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 778 days.

(21) Appl. No.: 12/513,653

(22) PCT Filed: Oct. 30, 2007

(86) PCT No.: PCT/US2007/022936

§ 371 (c)(1),
(2), (4) Date: May 5, 2009

(87) PCT Pub. No.: WO2008/057342

PCT Pub. Date: May 15, 2008

(65) Prior Publication Data

US 2010/0029391 A1 Feb. 4, 2010

Related U.S. Application Data

(60) Provisional application No. 60/857,565, filed on Nov. 8, 2006.

(51) Int. Cl.
*A63F 9/24* (2006.01)

(52) U.S. Cl. ..... 463/46

(58) Field of Classification Search ..... 463/46
See application file for complete search history.

(56) References Cited

U.S. PATENT DOCUMENTS

| | | | | |
|---|---|---|---|---|
| 1,837,797 | A | 12/1931 | Shipley | |
| 5,120,060 | A | 6/1992 | Parker et al. | |
| 5,649,997 | A | 7/1997 | Cavallero et al. | |
| 5,775,987 | A | 7/1998 | Brinket | |
| 5,956,227 | A | 9/1999 | Kitaoka | |
| 6,049,455 | A | 4/2000 | Nakamura et al. | |
| 6,439,992 | B1 | 8/2002 | Demeter | |
| 6,491,298 | B1 * | 12/2002 | Criss-Puszkiewicz et al. | 273/148 R |
| 6,506,114 | B1 | 1/2003 | Estes et al. | |
| 6,530,842 | B1 | 3/2003 | Wells et al. | |
| D495,755 | S * | 9/2004 | Wurz et al. | D21/370 |
| 6,786,474 | B2 | 9/2004 | Watkins et al. | |
| 6,902,481 | B2 | 6/2005 | Breckner et al. | |
| 7,036,027 | B2 * | 4/2006 | Kim et al. | 713/300 |
| 2003/0073478 | A1 | 4/2003 | Kovacs | |
| 2006/0073900 | A1 * | 4/2006 | Cole | 463/46 |
| 2007/0199287 | A1 * | 8/2007 | Wiser | 55/385.1 |

OTHER PUBLICATIONS

International Search Report—PCT/US2007/022936 dated Apr. 7, 2008 (2 pages).
Written Opinion—PCT/US2007/022936 dated Apr. 7, 2008 (5 pages).
Brochure, "I Love Lucy", IGT, Reno, Nevada, 4 pages.
Web Page, "The Sweet Smell of Slots", www.online-casino-gambling-guide.com/CasinoNews/200110_2691.htm, Oct. 5, 2001, 2 pages.

* cited by examiner

*Primary Examiner* — Matthew W Such
*Assistant Examiner* — Robert Carpenter
(74) *Attorney, Agent, or Firm* — Nixon Peabody LLP

(57) ABSTRACT

A gaming machine for conducting a wagering game includes a gaming machine cabinet having a front, a first sidewall, and a second sidewall. The first sidewall and the second sidewall are adjacent to the front. The gaming machine further comprises a display, a CPU, and a power supply mounted within the gaming machine cabinet. The gaming machine further comprises a first fan mounted adjacent to the CPU and oriented to pull air from outside the gaming machine cabinet over the CPU along a first air path. The gaming machine further comprises a second fan mounted adjacent to the power supply and oriented to push air exiting the power supply out of the gaming machine cabinet along a second air path. The first air path does not substantially intersect the second air path.

16 Claims, 9 Drawing Sheets

GAMING MACHINE VENTILATION SYSTEM

CROSS-REFERENCE To RELATED APPLICATIONS

This application is a U.S. national stage of International Application No. PCT/US2007/022936, filed Oct. 30, 2007, which is related to and claims priority to U.S. Provisional Application No. 60/857,565, filed Nov. 8, 2006, each of which is hereby incorporated by reference herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to gaming machines having an improved ventilation system.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

Gaming machines typically include various internal electrical components, which may include, for example, a central processing unit (CPU), one or more power supplies, a display, a communication board, a sound system, a printer, combinations thereof, or the like. Because many of these gaming machines remain "on" even when not being played, the internal components produce significant amounts of heat. Thus, many of the internal components require adequate ventilation to prevent damage to the components and/or premature component failure. For example, CPUs typically generate a significant amount of heat and only operate properly within a specified temperature range. Thus, most CPUs require a ventilation system of some type to prevent the CPU from overheating and/or failing.

In many prior art gaming machines, fans are placed within the gaming machine and/or within gaming machine components to improve air circulation within the gaming machine. Typically, the fans move the air within the gaming machine and distribute the air from one internal component to another to cool the internal components through one generally continuous flow path. Often, these gaming machines have only a single inlet vent for pulling air into the gaming machine and/or a single outlet vent for expelling heated air out of the gaming machine. Air entering the gaming machine through the inlet vent increases in temperature as it moves from one internal component to the next. Thus, the internal components that are near the end of the flow path are contacted by generally warm or hot air and are, therefore, only cooled slightly, if at all. Failure to sufficiently cool the internal components of the gaming machine may compromise the operation of the components and/or may cause the components to fail.

Another drawback of air flow re-circulating within the gaming machine is that internal particulates and contaminates may be passed from one internal component to another. The particulates and contaminates may impair the operation of sensitive components of the gaming machine and may even cause shorting or other malfunctions of circuitry.

It would be desirable to provide an improved gaming machine ventilation system that assists in addressing one or more of the above disadvantages.

SUMMARY OF THE INVENTION

According to one aspect of the present invention, a gaming machine for conducting a wagering game comprises a gaming machine cabinet having a front, a first sidewall, and a second sidewall. The first sidewall and the second sidewall are adjacent to the front. The gaming machine further comprises a display mounted within the gaming machine cabinet. The gaming machine further comprises a CPU mounted within the gaming machine cabinet. The gaming machine further comprises a power supply mounted within the gaming machine cabinet. The gaming machine further comprises a first fan mounted adjacent to the CPU and oriented to pull air from outside the gaming machine cabinet over the CPU along a first air path. The gaming machine further comprises a second fan mounted adjacent to the power supply and oriented to push air exiting the power supply out of the gaming machine cabinet along a second air path. The first air path does not substantially intersect the second air path.

According to another aspect of the invention, a method of ventilating a gaming machine for conducting a wagering game, the gaming machine having a gaming machine cabinet, the gaming machine further having a display, a CPU, and a power supply mounted within the gaming machine cabinet, the gaming machine cabinet including a front, a first sidewall, and a second sidewall, the first sidewall and the second sidewall being adjacent to the front is disclosed. The method comprises cooling the CPU with a first stream of air pulled from outside the gaming machine cabinet by a first fan. The method further comprises cooling the power supply with a second steam of air, the second stream of air substantially not intersecting with the first stream of air.

According to yet another aspect of the invention, a gaming machine arrangement comprises first and second gaming machines each having a respective cabinet. The cabinet has a front, a first sidewall, and a second sidewall. The first sidewall and the second sidewall are adjacent to the front. The first sidewall includes at least one inlet vent formed therein. The second sidewall includes at least one outlet vent formed therein. The cabinet of the first gaming machine is similarly shaped to the cabinet of the second gaming machine. When the second sidewall of the cabinet of the first gaming machine is positioned adjacent to the first sidewall of the cabinet of the second gaming machine, air exiting the outlet vent in the second sidewall of the cabinet of the first gaming machine is generally not aligned with the inlet vent in the first sidewall of the cabinet of the second gaming machine.

Additional aspects of the invention will be apparent to those of ordinary skill in the art in view of the detailed description of various embodiments, which is made with reference to the drawings, a brief description of which is provided below.

DETAILED DESCRIPTION

Figure 1:
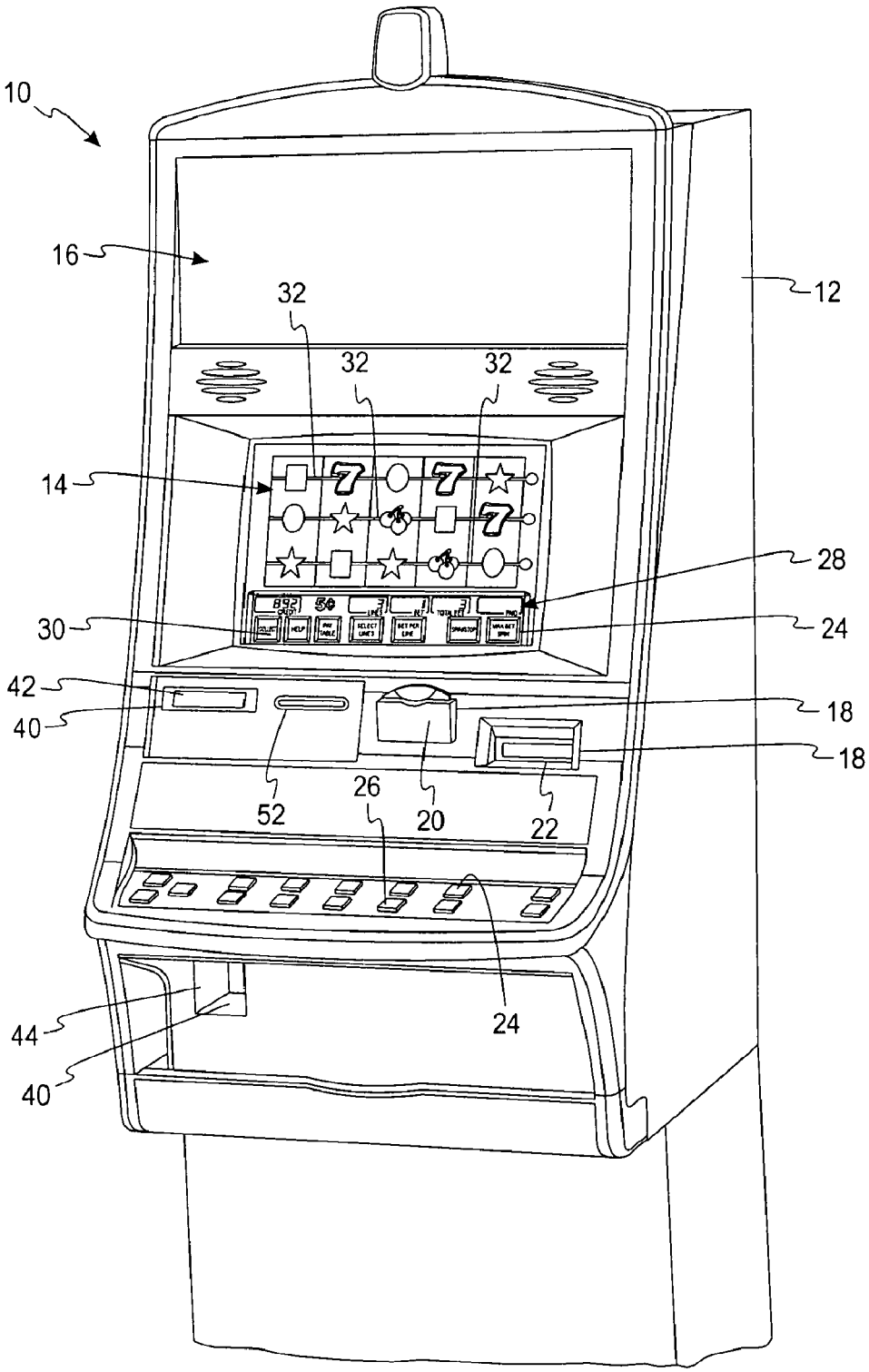
FIG. 1 is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1 as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 2:
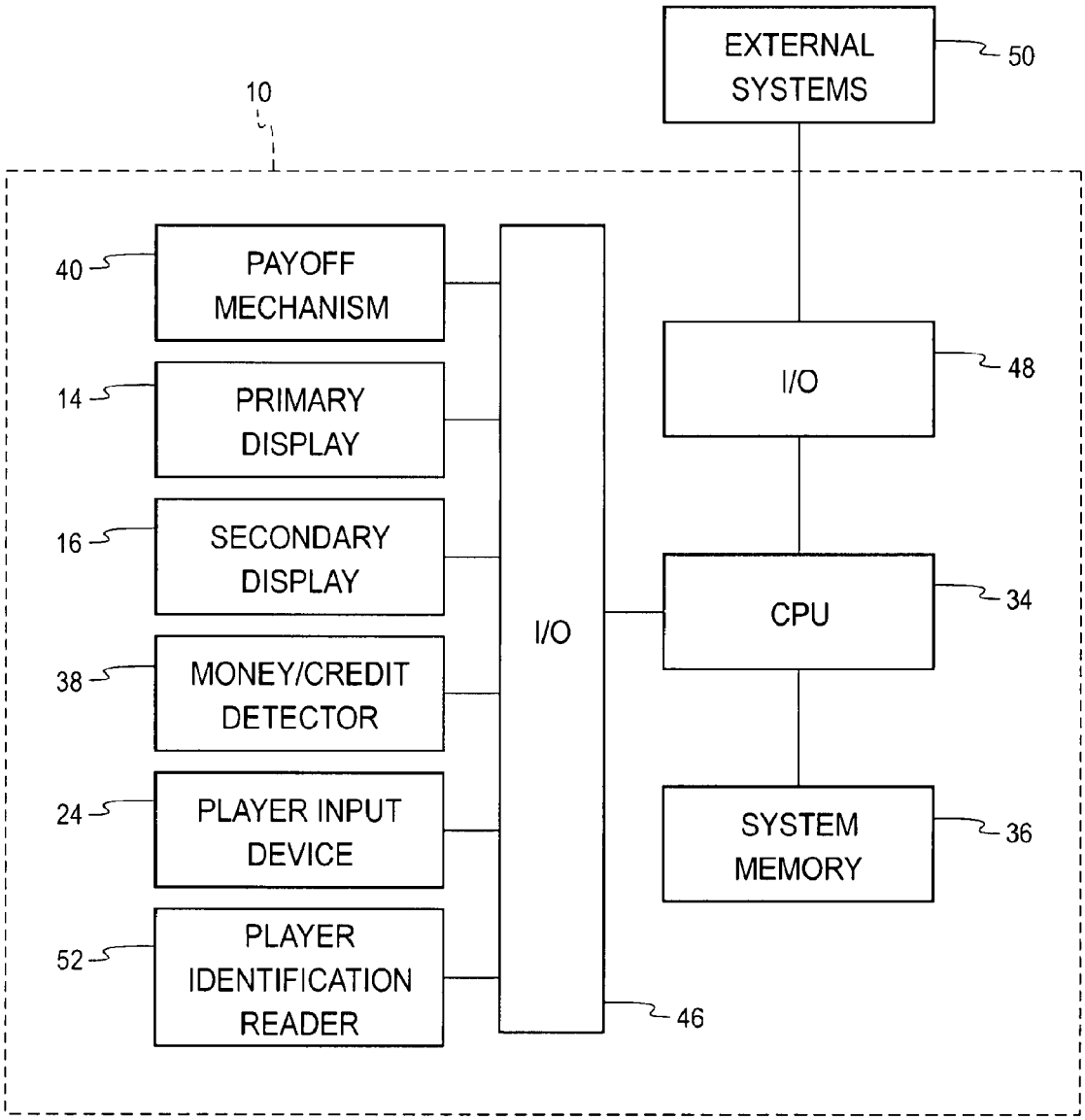
FIG. 2 is a block diagram of a control system suitable for operating the gaming machines of FIG. 1.

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10.

The gaming machines 10 may communicate with external systems 50 (in a wired or wireless manner) such that each machine operates as a "thin client," having relatively less functionality, a "thick client," having relatively more functionality, or through any range of functionality therebetween (e.g., a "rich client"). As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "rich client" configuration, the server determines game outcomes, while the controller 34 on board the gaming machine executes game code and processes display information to be displayed on the display(s) of the machines. In yet another alternative "thick client" configuration, the controller 34 on board the gaming machine 10 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machine 10 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Figure 3A:
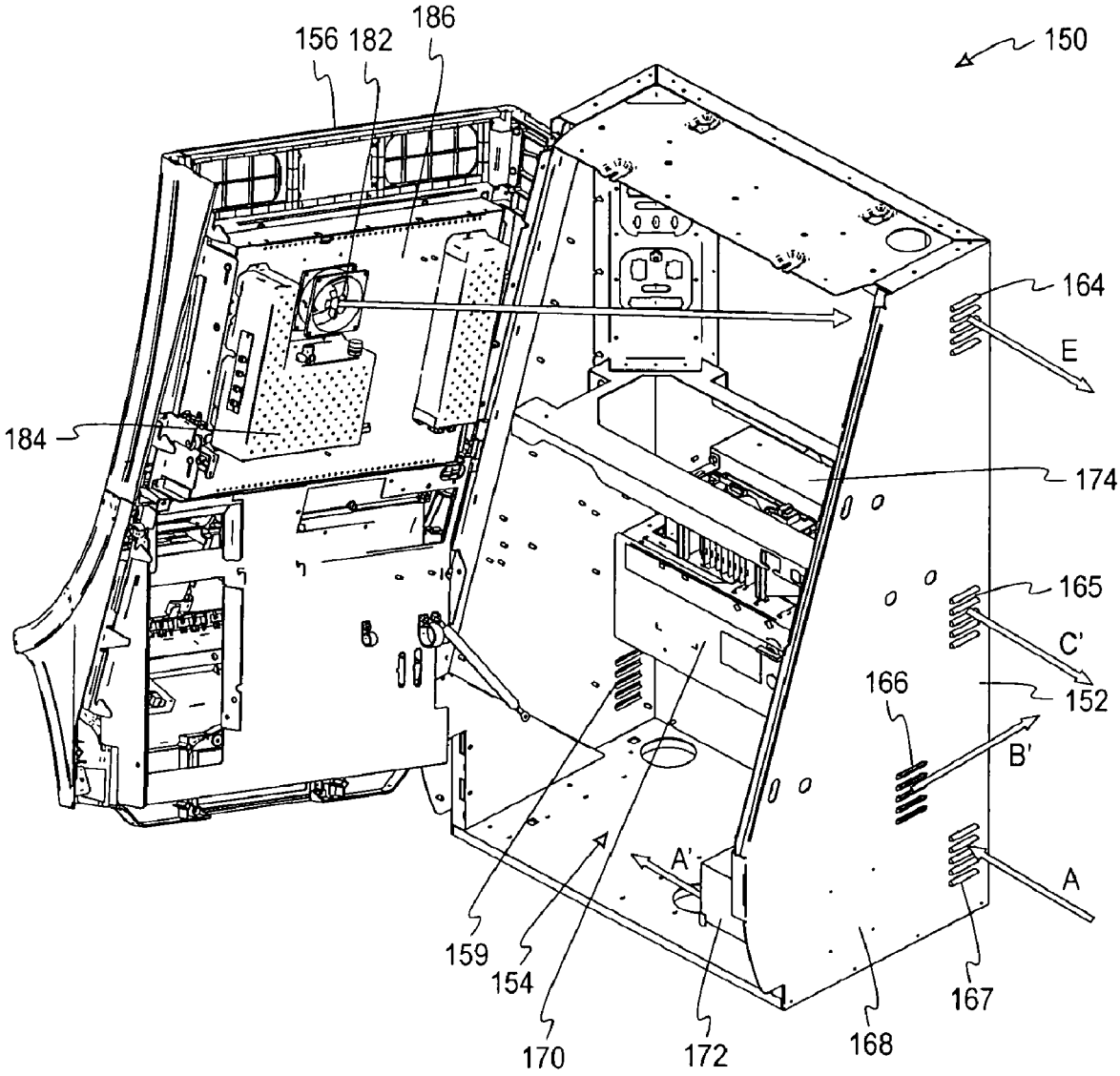
FIG. 3*a* is a perspective view of a side of a gaming machine cabinet having a main door in an open position according to one embodiment.
Figure 3B:
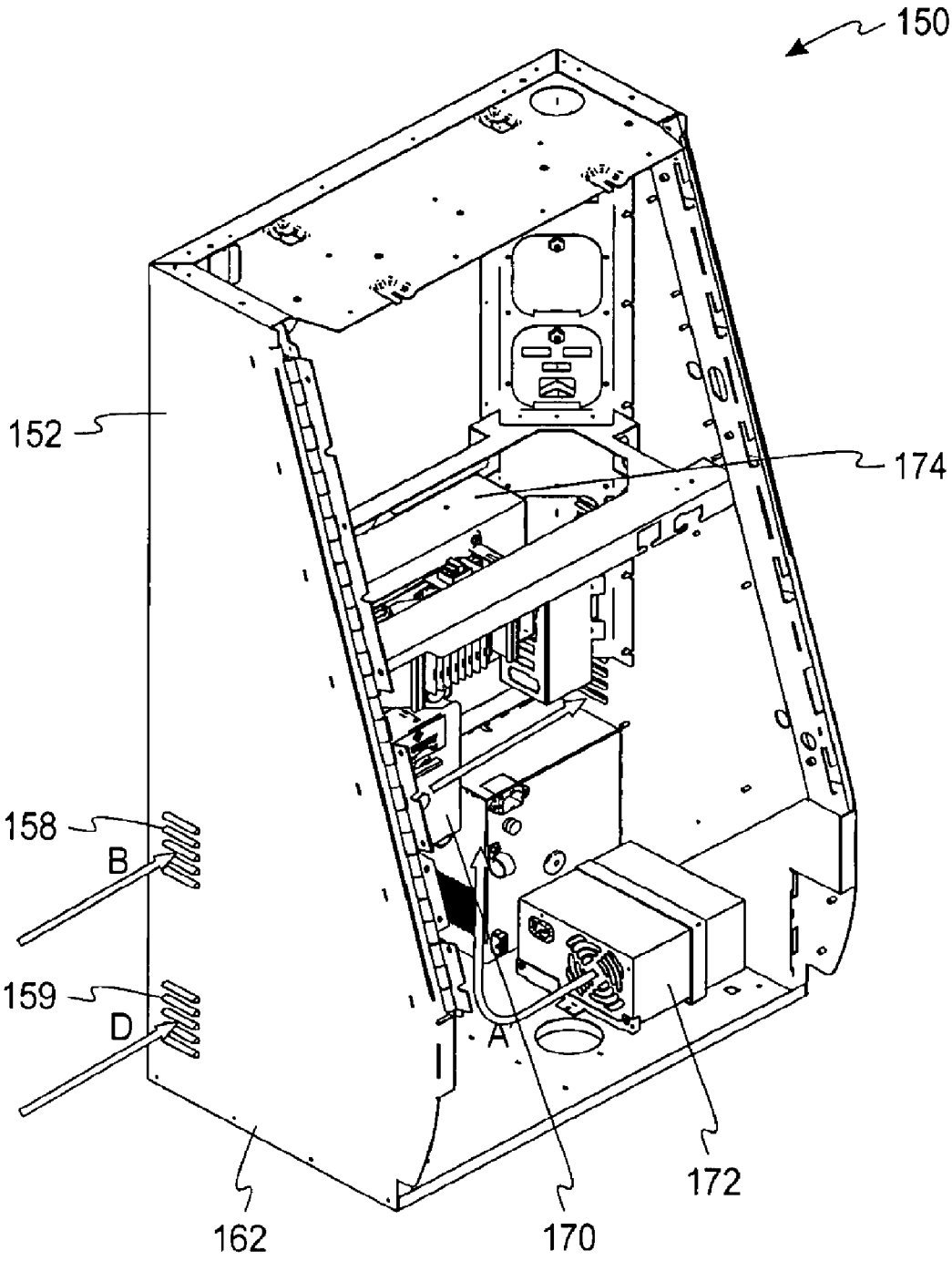
FIG. 3*b* is a perspective view of an opposing side of the gaming machine cabinet of FIG. 3*a;*
Figure 3C:
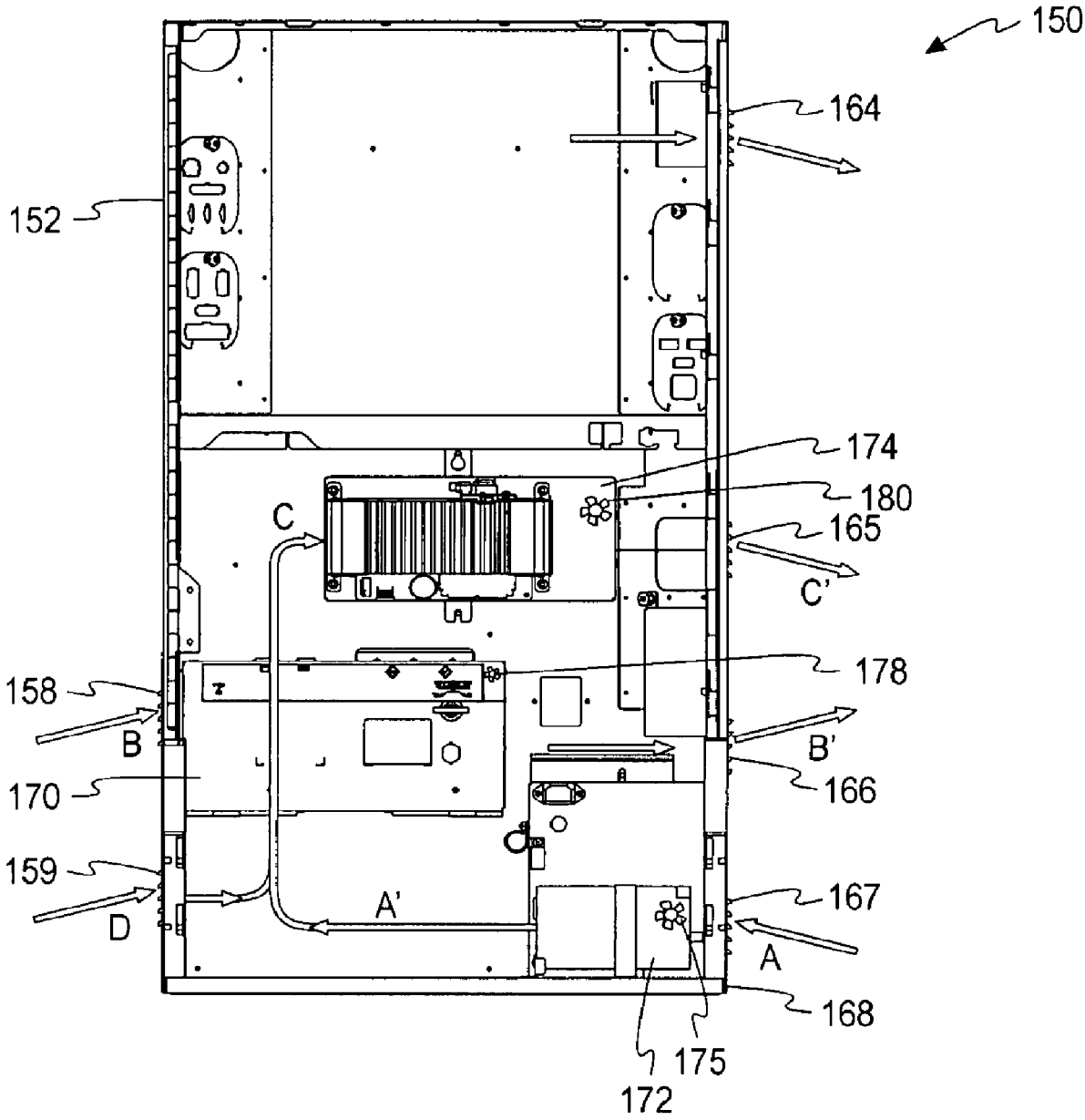
FIG. 3*c* is a front view of the gaming machine cabinet of FIGS. 3*a,b;*

Turning now to FIGS. 3*a-c,* a gaming machine 150 similar to the gaming machine 10 of FIG. 1 is shown according to one embodiment. The gaming machine 150 includes a main cabinet 152, which generally surrounds an interior 154 of the gaming machine 150 and is viewable by players. The cabinet 152 includes a main door 156 forming a front of the gaming machine 150. The main door 156 opens to provide access to the interior 154 of the gaming machine 150. FIG. 3*a* shows the cabinet 152 with the main door 156 in an open position, and FIGS. 3*b-c* show the cabinet 152 with the main door 156 removed (for clarity). As shown in FIG. 1, push buttons 24, the bill acceptor 22, the coin outlet 44, and/or the like may be attached to or formed on the main door 156. For clarity in illustrating the air flow within the gaming machine 150, all of the gaming components that may be mounted within the gaming machine 150 are not shown in the figures.

The major thermal sources within the main cabinet 152 generally include a CPU, a power supply, and a monitor or display (e.g., primary display 14 of FIG. 1). In the illustrated example, the CPU is mounted within a CPU box 176, which is designed to fit within a CPU enclosure 170 (see FIG. 4). The main cabinet 152 of the illustrated example includes two power supplies: a first power supply 172 and an second power supply 174. Cabinets of other gaming machines may include a different number of power supplies (i.e., one or more than two). Typically, there is a maximum operational temperature for the CPU, the power supplies 172, 174, and the primary display 14. When the maximum operational temperature is exceeded for any of the components, the components may cease to operate properly or fail. For example, the CPU may begin to malfunction and fail when the temperature within the CPU and/or the CPU enclosure 170 exceeds 100° F.

To prevent component malfunctions caused by over-heating, a ventilation system is employed. Specifically, the ventilation system described herein inhibits or prevents warm air that has been used to cool a component (e.g., CPU, power supplies 172, 174, or display 14) within the main cabinet 152 from continuously re-circulating within the main cabinet 152 or into other, adjacent gaming machine cabinets. The ventilation system described herein utilizes fans, vents, and placement of the components and vents to inhibit or prevent a first air stream entering a gaming machine for cooling a component from substantially intersecting with a second, warm air stream previously used to cool another component. Although it is understood that the general movement of air may cause the first air stream and the second air stream to interact slightly, the embodiments described herein are designed to diminish such interaction. Accordingly, the ventilation systems described herein assist in preventing internal components within a gaming machine from overheating.

The gaming machine 150 of FIGS. 3*a-c* is shown having two vents 158-159 formed on a first side 162 of the gaming machine 150 and four vents 164-167 formed on a second, opposing side 168. The number and/or location of the vents may vary depending on various factors including the placement of the components within the gaming machine 150.

The first power supply 172 may be placed adjacent to a vent on a side of the main cabinet 152. Although in FIGS. 3*a-c,* the first power supply 172 is placed adjacent to the bottom of the gaming machine 150 and a vent 167 on the second side 168 (i.e., the right side) of the main cabinet 152, the first power supply 172 may be positioned in other suitable locations such as, for example, adjacent to another vent positioned on another side of the cabinet 152. The first power supply 172 includes a fan 175 (see FIG. 3*c*) mounted thereto, therein, or adjacent thereto. When the fan 175 is operating, the fan 175 pulls cool air from outside the gaming machine 150 through the vent 167 into and across the first power supply 172, thereby cooling the first power supply 172. The air flow into the first power supply 172 is shown by Arrow A, and the air flow out of the first power supply is shown by Arrow A'. In other embodiments, air flows through the first power supply 172 in a direction generally opposite to Arrows A and A'.

The CPU is generally one of the most thermally sensitive components within a gaming machine 150. Because of such thermal sensitivity, it is desirable for air entering the CPU enclosure 170 to cool the CPU enclosure 170 to have as low a temperature as possible. The coolest air is generally outside of the main cabinet 152, since air within the main cabinet 152 is often warmed from previously cooling another component (e.g., first power supply 172, second power supply 174) within the main cabinet 152.

Figure 4:
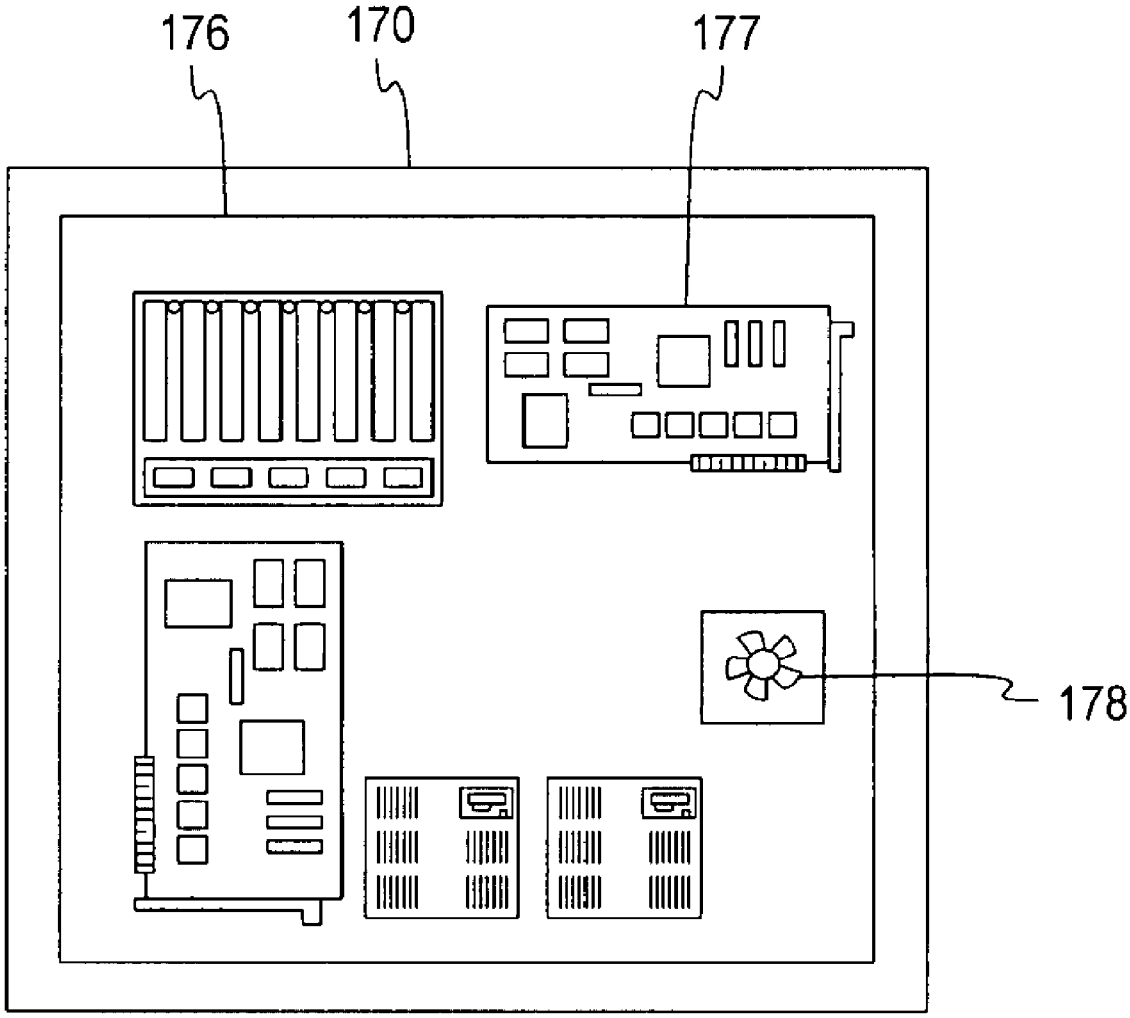
FIG. 4 is a side, internal view of a CPU enclosure.

Turning to FIG. 4, a side view of a CPU box 176 is shown within the CPU enclosure 170. The CPU box 176 encloses a CPU 177 (e.g., a CPU board) and a CPU enclosure fan 178. The CPU enclosure fan 178 pulls cool air, denoted by Arrow B, from outside the main cabinet 152 in through the vent 158 on the first side 162 of the main cabinet 152 (FIG. 3*c*). Air is then drawn into an inlet in the CPU enclosure 170, through the CPU enclosure 170, and pushed outward through an outlet in the CPU enclosure 170 by the fan 178 or another fan inside of or adjacent to the CPU enclosure 170. The warmed air, denoted by Arrow B', then continues out of the main cabinet 152 through the vent 166 on the second side 168 of the main cabinet.

The air used to cool the CPU enclosure 170 may also flow through the CPU enclosure 170 in a direction opposite to Arrows B and B'. In this case, the fan 178 pulls cool air from outside of the main cabinet 152 in through the vent 166, through the CPU enclosure 170, and out of the main cabinet 152 through the vent 159. Regardless of the direction, air used to cool the CPU 177 flows in a generally horizontal pathway through the CPU enclosure 170 and through the main cabinet 152.

Although in FIGS. 3*a-c* the CPU enclosure 170 is positioned at or near the center of the main cabinet 152, the CPU enclosure 170 may be positioned in other suitable locations within the main cabinet 152. Furthermore, although in the illustrated embodiment, the CPU enclosure 170 is positioned adjacent to the first side 162, the CPU enclosure 170 may be positioned adjacent to the second side 168 or in some intermediate position between the first side 162 and the second side 168.

A third air stream, denoted by Arrow C (FIG. 3*c*), flows into the second power supply 174 to cool the second power supply 174. As shown in FIGS. 3*a-c,* the air flowing into the second power supply 174 includes air (denoted by Arrow D) from outside of the gaming machine 150 entering the main cabinet 152 through the vent 159 combined with air (denoted by Arrow A') exiting the first power supply 172. The second power supply 174 has a dedicated fan 180 mounted thereto. When the fan 180 is operating, it pulls air (Arrow C) into and across the second power supply 174 to cool the second power supply 174.

Referring again to FIGS. 3*a-c,* the second power supply 174 generally produces a substantial amount of heat. Thus, air used to cool the second power supply 174 exits the second power supply 174 at a relatively high temperature. Because this heated air is less effective in cooling other components of the gaming machine 150 than, for example, cooler air outside of the gaming machine 150, it is desirable that the heated air exiting the second power supply 174 flow generally out of the main cabinet 152. Thus, as shown in FIGS. 3*a-c,* the fan 180 or another fan inside of or adjacent to the second power supply 174 forces the heated air (denoted by Arrow C') exiting the second power supply 174 out of the main cabinet 152 through a vent 165. Although in the illustrated embodiment, the second power supply 174 is positioned adjacent to the vent 165 on the second side 168 of the main cabinet 152, it is contemplated that the second power supply 174 may be positioned near another vent positioned on another side of the main cabinet 152.

Referring to FIG. 3*a,* the primary display 14 (see FIG. 1) also includes a fan 182 for aiding in cooling the primary display 14. In the example shown in FIG. 3*a,* air from the interior 154 of the gaming machine 150 flows into the primary display 14 through a plurality of apertures 184 located on a back side 186 of the primary display 14. The air in the interior 154 may, for example, enter the interior 154 through the vent 159. The fan 182 then blows the air used to cool the primary display 14 away from the primary display 14 out of the main cabinet 152 through the vent 164, as depicted by Arrow E.

In another embodiment, air used to cool the primary display 14 flows through the primary display 14 in a direction generally opposite to Arrow E. In this embodiment, the fan 182 pulls air into the gaming machine cabinet 152 and the primary display 14 through the vent 164 and pushes warmed air out of the primary display 14 through the apertures 184.

Figure 5A:
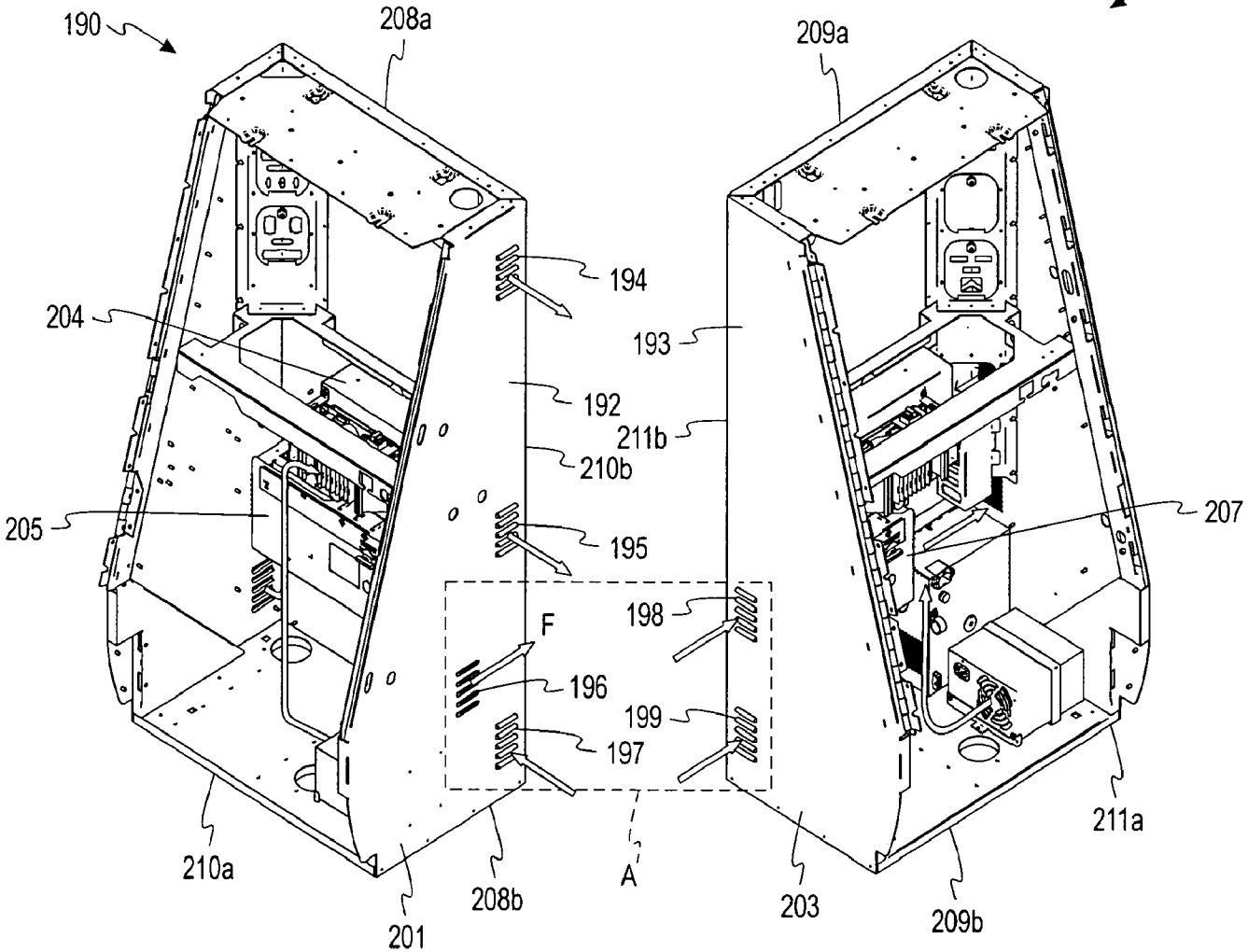
FIG. 5*a* is a perspective side view of adjacent gaming machine cabinets according to one embodiment.

FIG. 5*a* shows two gaming machines 190, 191 positioned adjacent to each other. The gaming machines 190, 191 include main cabinets 192, 193, respectively, that are substantially identical to each other and to the main cabinet 152 of FIGS. 3*a-c*. In use (e.g., in a casino environment), a right side 201 of the first gaming machine 190 is adjacent to a left side 203 of the second gaming machine 191.

As shown in FIG. 5*a,* the position of vents 194-197 formed on the right side 201 of the first gaming machine 190 are generally offset relative to vents 198, 199 formed on the left side 203 of the second gaming machine 191. The vents 194-197 may be offset from the vents 198-199 by varying the distance of the vents 194-199 from a top 208*a,* 209*a* or a bottom 208*b,* 209*b* of the gaming machines 190, 191, by varying the position of the vents 194-199 relative to a front 210*a,* 211*a* or a back 210*b,* 211*b* of the gaming machines 190, 191. combinations thereof, or the like. Thus, the position of the vents 194-199 as well as the direction of air flow through the vents 194-190 is such that warmed air exiting the first gaming machine 190 (e.g., through one or more outlet vents 194-196) will not directly enter the second gaming machine 191 (e.g., through one or more of the vents 198, 199). Likewise, warm air exiting the second gaming machine 191 (e.g., through vent 198) will not directly enter the first gaming machine 190 (e.g., through one or more inlet vents 196, 197). For example, because the vents 195 and 196 are offset from the vent 198, air (denoted by Arrow F) used to cool a second power supply 204 and/or a CPU enclosure 205 of the first gaming machine 190 does not flow directly out of the respective outlet vents 195, 196 of the first gaming machine 190 into the second gaming machine 191 through the vent 198 to cool a CPU enclosure 207 of the second gaming machine 191. Thus, cooler air (i.e., air located outside the gaming machine 191 at generally ambient temperature) than that flowing out of the outlet vents 195, 196 may be used to cool the CPU enclosure 207 of the second gaming machine 191.

Figure 5B:
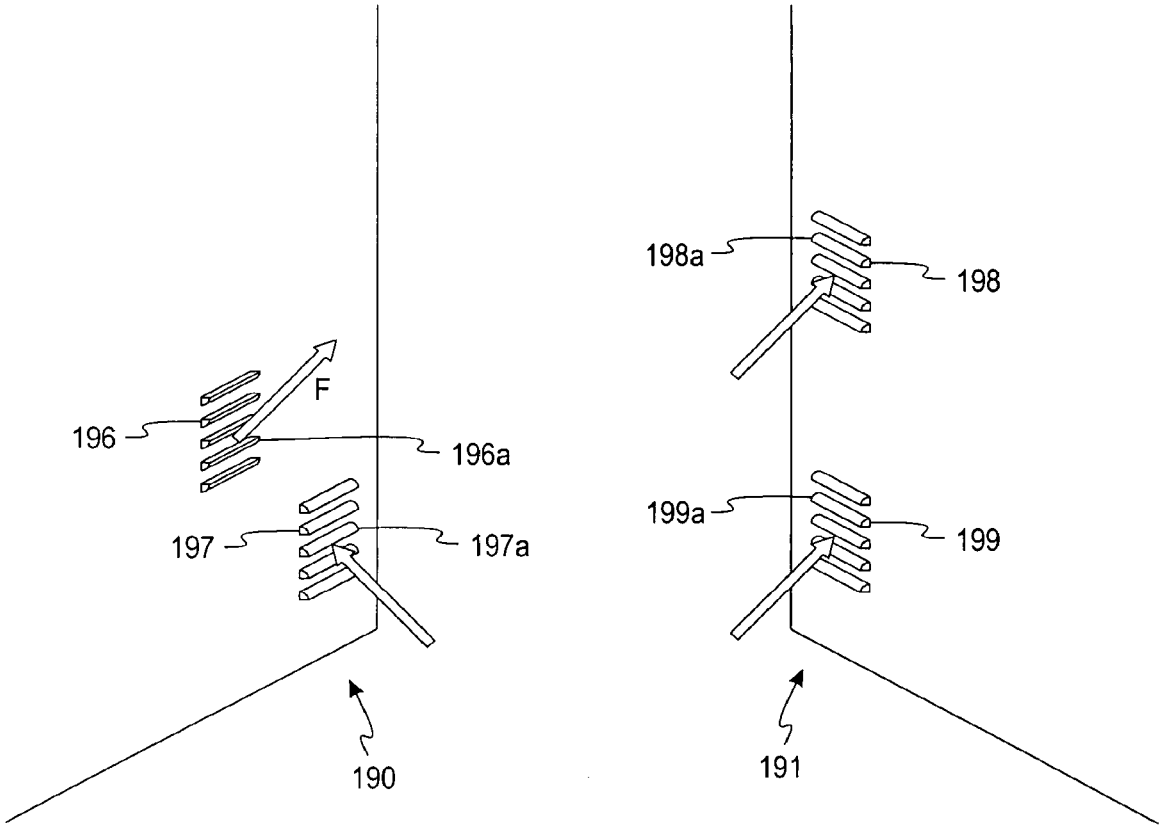
FIG. 5*b* is a blown-up view of Section A of FIG. 5*a;*

Another way of minimizing the amount of warmed air pulled into a gaming machine for cooling a component is to vary the position of louvers of one or more vents formed on a side of the gaming machine. Turning to FIG. 5*b,* for example, a blown-up view of Section A of FIG. 5*a* is shown. Each of the vents 196-199 includes respective louvers 196*a,* 197*a,* 198*a,* 199*a*. The louvers 196*a* of the outlet vent 196 are generally slanted in a upward direction. The upwardly slanted louvers 196*a* cause warmed air used to cool the CPU enclosure 205 and exiting the gaming machine 190 to flow out of the outlet vent 196 in a generally upward direction. Thus, the warmed air is less likely to be pulled in through inlet vents 197-199, which are positioned generally below the outlet vent 196. Furthermore, the louvers 197*a*-199*a* of the corresponding inlet vents 197-199 are generally slanted in a downward direction so that the warmed air exiting the outlet vent 196 is even less likely to be pulled in through the inlet vents 197-199. It should be understood that the direction of the slants of each of the respective louvers may be adjusted in accordance with the position of the respective vent, the direction of air flow through the vent, and the like.

Figure 6:
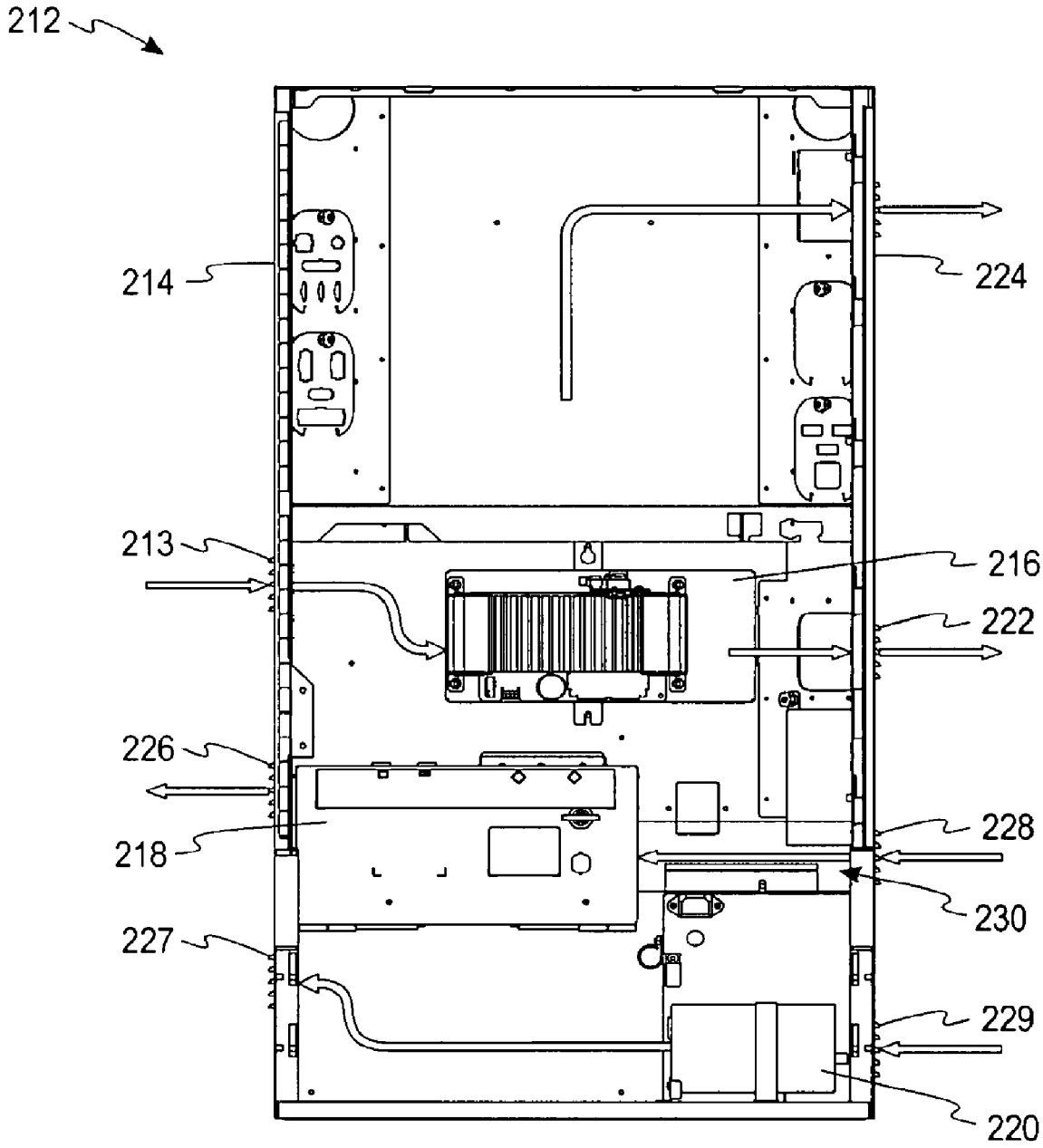
FIG. 6 is a front view of a gaming machine cabinet according to another embodiment.

FIG. 6 shows a gaming machine 212 according to another embodiment. The gaming machine 212 is similar to the gaming machines 150, 190, 191 of FIGS. 3*a-c* and 5*a-b*. The gaming machine 212, however, includes an additional vent 213 positioned on a left side 214 of the gaming machine 212. Thus, each of the major components (e.g., second power supply 216, CPU enclosure 218, and first power supply 220) receives air directly from outside the gaming machine 212 to cool the respective components 216, 218, 220. Moreover, warmed air exiting each of the major components 216, 218, 220 after the components 216, 218, 220 have been cooled flows generally directly out of the gaming machine 212. For example, air flows in a generally horizontal pattern from outside the gaming machine 212 through the inlet vent 213, through the second power supply 216, and out of the gaming machine 212 through an outlet vent 222 positioned a right side 224 of the gaming machine 212. Air flows through the CPU enclosure 218 and the first power supply 220 in a similar manner.

As described above, it may be desirable for the position of the vents 213, 226, 227 formed on the left side 214 of the gaming machine 212 to be slightly offset relative to the positions of the vents 222, 228, 229 formed on the right side 224 of the gaming machine 212. Thus, the vents 213, 226, 227 on the left side 214 are not directly across from the vents 222, 228, 229 on the right side 224. As described above with respect to FIGS. 5*a,b,* offsetting the vents 213, 222, 226-229 inhibits or prevents warmed air exiting the gaming machine 212 from directly entering a similar, adjacent gaming machine (as shown, for example, in FIGS. 5*a,b*). The direction of air flow shown in FIG. 6 is not intended to limit the embodiment. Rather, the direction of air flow for each of the components 216, 218, 220 may be in any direction (i.e., from left to right or from right to left). Additionally or alternatively, the vents 212-213, 226-229 may have louvers slanted such that a warmed air stream exiting the gaming machine 212 may not intersect with cool air stream entering a similar gaming machine, as described above with respect to FIGS. 5*a,b*.

In each of the examples described above, air ducts may be added to direct air flow directly to or from one or more of the components. Referring again to FIG. 6, for example, an air duct 230 connects the vent 228 to the CPU enclosure 218, thereby ensuring that substantially all of the air exiting the CPU enclosure 218 is pushed directly out of the gaming machine 212 and, therefore, does not intersect with other air streams used to cool other components of the gaming machine 212. Furthermore, in each of the examples described above, although only a single fan is shown in or adjacent to each of the CPU enclosure, the first power supply, and the second power supply, more than one fan may also be used in each of the components.

Each of these embodiments and obvious variations thereof is contemplated as falling within the spirit and scope of the claimed invention, which is set forth in the following claims.

What is claimed is:

1. A gaming machine for conducting a wagering game comprising:

a gaming machine cabinet having a front, a first sidewall, and a second sidewall, the first sidewall and the second sidewall being adjacent to the front; a display mounted within the gaming machine cabinet; a CPU mounted within the gaming machine cabinet;

a power supply mounted within the gaming machine cabinet;

a first fan mounted adjacent to the CPU and oriented to pull air from outside the gaming machine cabinet through a first vent over the CPU along a first air path; and a second fan mounted adjacent to the power supply, the power supply being cooled by a second air path, the second fan being oriented to push air exiting the power supply directly out of the gaming machine cabinet through a second vent along the second air path, the second vent being positioned on one of the first and second sidewalls, wherein the first air path does not substantially intersect the second air path.

2. The gaming machine of claim 1, wherein the first fan is further oriented to push air exiting the CPU directly out of the gaming machine cabinet.

3. The gaming machine of claim 1, further comprising a second power supply mounted within the gaming machine cabinet and having a third fan mounted adjacent thereto, the third fan being oriented to pull air from outside of the gaming machine cabinet over the second power supply.

4. The gaming machine of claim 3, wherein the second fan is further oriented to pull air from outside of the gaming machine cabinet, air exiting the second power supply, or a combination thereof over the power supply.

5. The gaming machine of claim 1, further comprising:

a first set of vents formed on the first sidewall of the gaming machine cabinet; and a second set of vents formed on the second sidewall of the gaming machine cabinet.

6. The gaming machine of claim 5, wherein the first set of vents and the second set of vents are offset such that the first set of vents are not positioned directly across from the second set of vents.

7. The gaming machine of claim 1, wherein the CPU is positioned within a CPU enclosure.

8. The gaming machine of claim 7, further comprising one or more air ducts connecting at least one of the CPU enclosure and the power supply to one or more of the vents.

9. A method of ventilating a gaming machine for conducting a wagering game, the gaming machine having a gaming machine cabinet, the gaming machine further having a display, a CPU, and a power supply mounted within the gaming machine cabinet, the gaming machine cabinet including a front, a first sidewall, and a second sidewall, the first sidewall and the second sidewall being adjacent to the front, the method comprising: cooling the CPU with a first stream of air pulled from outside the gaming machine cabinet through a first vent by a first fan;

cooling the power supply with a second steam of air, the second stream of air substantially not intersecting with the first stream of air; and pushing at least one of the first stream of air exiting the CPU and the second stream of air exiting the power supply directly out of the gaming machine cabinet through a second vent using a second fan, the second vent being positioned on one of the first and second sidewalls.

10. The method of claim 9, further comprising pushing the second stream of air out of the gaming machine cabinet using a second fan.

11. The method of claim 9, further comprising pushing the first stream of air exiting the CPU directly out of the gaming machine cabinet.

12. The method of claim 9, further comprising pulling at least a portion of the second stream of air from outside of the gaming machine cabinet.

13. The method of claim 9, further comprising:

providing a first set of vents on the first sidewall of the gaming machine cabinet; and providing a second set of vents on the second sidewall of the gaming machine cabinet.

14. The method of claim 13, wherein the first set of vents and the second set of vents are offset such that the first set of vents are not positioned directly across from the second set of vents.

15. The method of claim 9, wherein the CPU is positioned within a CPU enclosure.

16. The method of claim 15, further comprising connecting at least one of the CPU enclosure and the power supply to one or more of the vents using one or more air ducts.

* * * * *